US006919859B2

(12) United States Patent
McCarthy et al.

(10) Patent No.: US 6,919,859 B2
(45) Date of Patent: Jul. 19, 2005

(54) ANTENNA

(75) Inventors: Robert Daniel McCarthy, Newbury Park, CA (US); Russell Alan Fix, Camarillo, CA (US)

(73) Assignee: PCTel, Hanover Park, IL (US)

( * ) Notice: Subject to any disclaimer, the term of this patent is extended or adjusted under 35 U.S.C. 154(b) by 41 days.

(21) Appl. No.: 10/658,732

(22) Filed: Sep. 9, 2003

(65) Prior Publication Data

US 2005/0052336 A1 Mar. 10, 2005

(51) Int. Cl.[7] ..... H01Q 1/36; H01Q 1/50

(52) U.S. Cl. ..... 343/895; 343/860; 343/853

(58) Field of Search ..... 343/895, 860, 343/845, 846, 850, 853, 701, 745; H01Q 1/36, 1/50

(56) References Cited

U.S. PATENT DOCUMENTS

| | | | | |
|---|---|---|---|---|
| 4,554,554 A | | 11/1985 | Olesen et al. | 343/895 |
| 5,198,831 A | | 3/1993 | Burrell et al. | 343/895 |
| 5,541,617 A | * | 7/1996 | Connolly et al. | 343/895 |
| 5,828,348 A | | 10/1998 | Tassoudji et al. | 343/895 |
| 5,920,292 A | | 7/1999 | O'Neill, Jr. | 343/895 |
| 6,011,524 A | | 1/2000 | Jervis | 343/895 |
| 6,034,650 A | | 3/2000 | Kuramoto | 343/895 |
| 6,094,178 A | | 7/2000 | Sanford | 343/895 |
| 6,184,844 B1 | | 2/2001 | Filipovic et al. | 343/895 |
| 6,373,448 B1 | | 4/2002 | Chun | 343/895 |
| 6,421,026 B2 | * | 7/2002 | Nishino et al. | 343/860 |
| 6,429,830 B2 | * | 8/2002 | Noro et al. | 343/895 |
| 6,496,154 B2 | | 12/2002 | Gyenes | 343/745 |

* cited by examiner

*Primary Examiner*—Trinh Vo Dinh
(74) *Attorney, Agent, or Firm*—Welsh & Katz, Ltd.

(57) ABSTRACT

An antenna including a feed network; four or more helical radiating elements, and four or more impedance matching stubs each coupling a respective radiating element to ground in parallel with the feed network. The shunt stubs provide a reactance in parallel with the radiating elements to rotate the desired frequency locus about a constant admittance curve. Specifically, the shunt stubs rotate the desired frequency locus from a low resistance, capacitive impedance to 50 ohms purely resistive. The length of the stubs can be adjusted to control the inductance.

24 Claims, 4 Drawing Sheets

ANTENNA

FIELD OF THE INVENTION

The present invention relates to an antenna with four or more helical radiating elements, such as a quadrifilar or octafilar helix antenna.

DESCRIPTION OF THE RELATED ART

The input impedance of a quadrifilar helix radiating element is a function of resonant length, pitch angle and helix diameter. It is desirable to match the input impedance of the element to the output impedance of the feed network, which is typically 50 ohms. However, the helix diameter needed to provide a 50 ohm input impedance is typically larger than packaging constraints will allow. For example, a diameter of 1.5 inches is required for an antenna operating at the GPS L1 frequency of 1575 MHz. At diameters less than one inch (which are desirable for cosmetic and packaging reasons), the input impedance can be as low as 2–10 ohms.

One way of approaching this problem is to provide a widened transformer section in each antenna feed line, as shown in U.S. Pat. No. 5,828,348. The increased line width of the transformer sections results in packaging problems. An alternative method is described in U.S. Pat. No. 5,198,831 and U.S. Pat. No. 6,184,884. In this case, the feedpoint of each radiating element is elevated to a position where a 50 ohm impedance (or other higher impedance) is obtained.

BRIEF DESCRIPTION OF EXEMPLARY EMBODIMENT

An exemplary embodiment of the invention provides an antenna including a feed network; four or more helical radiating elements, and four or more impedance matching elements each coupling a respective radiating element to ground in parallel with the feed network.

BRIEF DESCRIPTION OF THE DRAWINGS

Illustrative embodiments of the invention will now be described with reference to the accompanying drawings to disclose the advantageous teachings of the present invention.

DETAILED DESCRIPTION OF EMBODIMENTS OF THE INVENTION

Figure 1:
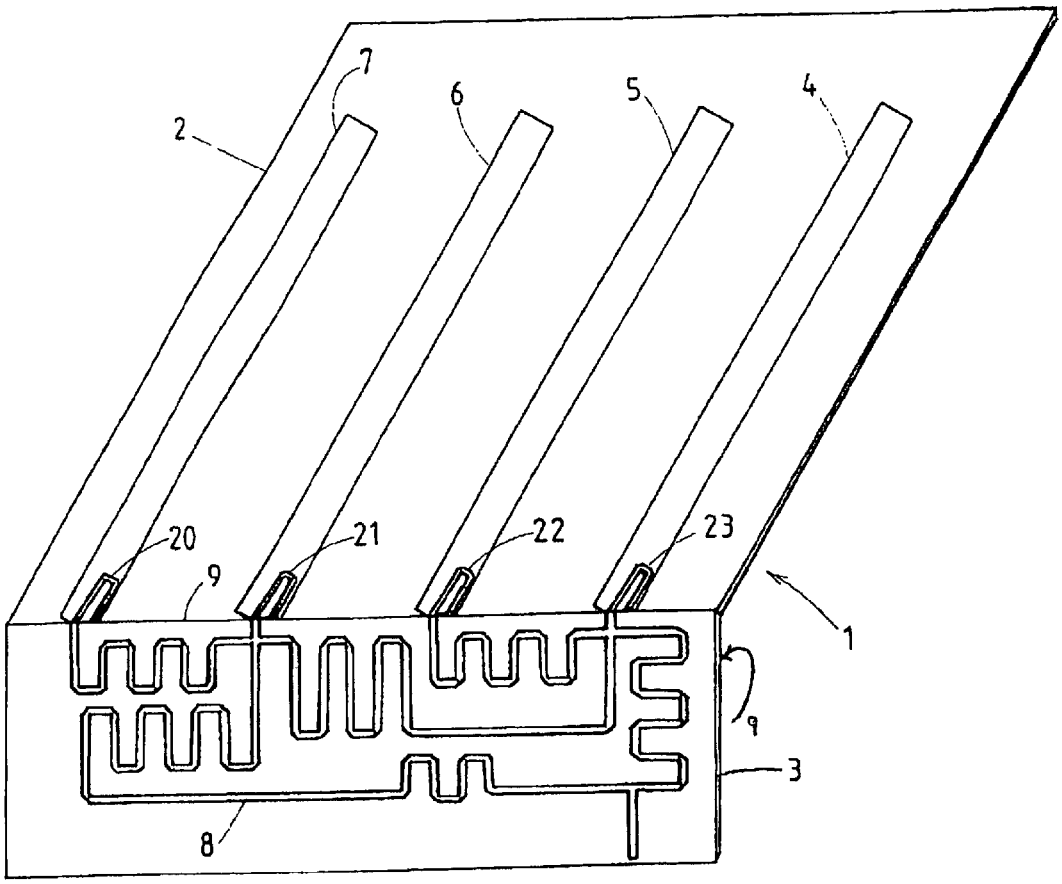
FIG. 1 is a planar view of an open circuit quadrifilar antenna constructed in accordance with the teachings of the present invention.

FIG. 1 is a planar view of a quadrifilar helix antenna 1 constructed in accordance with the teachings of the present invention. The antenna 1 is made of a radiating segment 2 and a base segment 3. FIG. 1 shows the front side of the antenna, but hidden elements on the rear side of the antenna are also shown. The radiating segment 2 includes radiating elements 4–7 on the front side, and shunt inductors 20–23 on the rear side. The base segment 3 contains a microstrip hybrid junction power divider feed circuit 8 on the front side and a ground plane 9 on the rear side. Both segments 2,3 of the antenna 1 are made of one single section of dielectric substrate on which copper (or any suitable conductor) is deposited or etched to form the radiating elements 4–7, the hybrid junction power divider feed circuit 8, the shunt inductors 20–23 and the ground plane 9.

As is illustrated in FIG. 1, the radiating elements 4–7 are connected to the hybrid junction power divider feed circuit 8 at one end and are open circuited at the other end. The length of each of the four radiating elements is initially ¼ wavelength. However, after tuning and compensation for end effects, the resulting length is shorter than ¼ wavelength. Nevertheless, the elements operate in ¼ wavelength mode.

Figure 2:
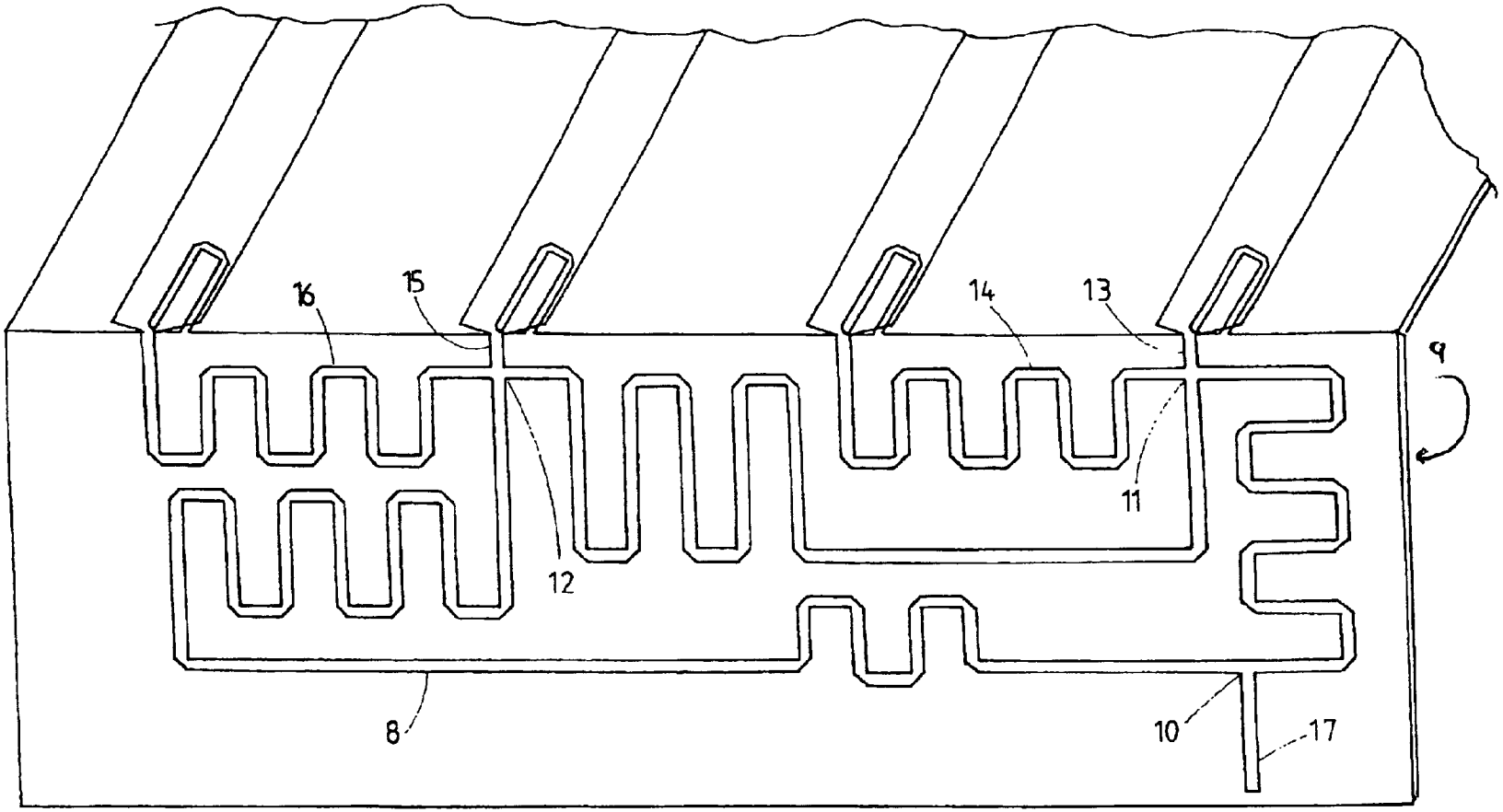
FIG. 2 is an enlarged view of the base segment.

The feed circuit 8 is shown in detail in FIG. 2. The circuit 8 has a feed port 10, 0° hybrid port 11 and −180° hybrid port 12. A short antenna feedline 13 and a 90° phased line 14, extend from the 0° hybrid port 11. Similarly, a short antenna feedline 15 and a 90° phased line 16 extend from the 180° hybrid port 12. The radiating elements 4–7 are contiguous with the lines 13–16 respectively. The radiating elements are driven in phase quadrature, providing the phase relationships required by circularly polarized beam patterns.

The helical pattern is accomplished by designing the upper segment 2 as a parallelogram having vertical sides set at a predetermined angle (e.g., 50 degrees) above the horizontal line of the rectangularly shaped lower segment 3. The radiating elements are then disposed at the same angle. Thus, once the antenna is turned into a cylinder such that the angled sides of the parallelogram as well as the two vertical sides of the lower segment touch each other to form a seam, the radiating elements produce a helical pattern relative to each other. Note that the helical pattern is controlled by the pitch of the chosen angle. Hence, the more acute the angle, the more turns there will be in the helices formed by the radiating elements 4–7 upon the cylindrical transformation of the planar antenna of FIG. 1. (see FIG. 3.)

A 50 ohm line 17 extends downward from the feed port 10 to a connector (not shown). Although a 50 ohm line is used in this embodiment, it is not absolutely required. Therefore, in an alternative embodiment the connector may be placed adjacent to the hybrid junction power divider feed circuit 8 thereby circumventing the use of the 50 ohm line. Also, impedances other than 50 ohm may be employed if required.

Figure 3:
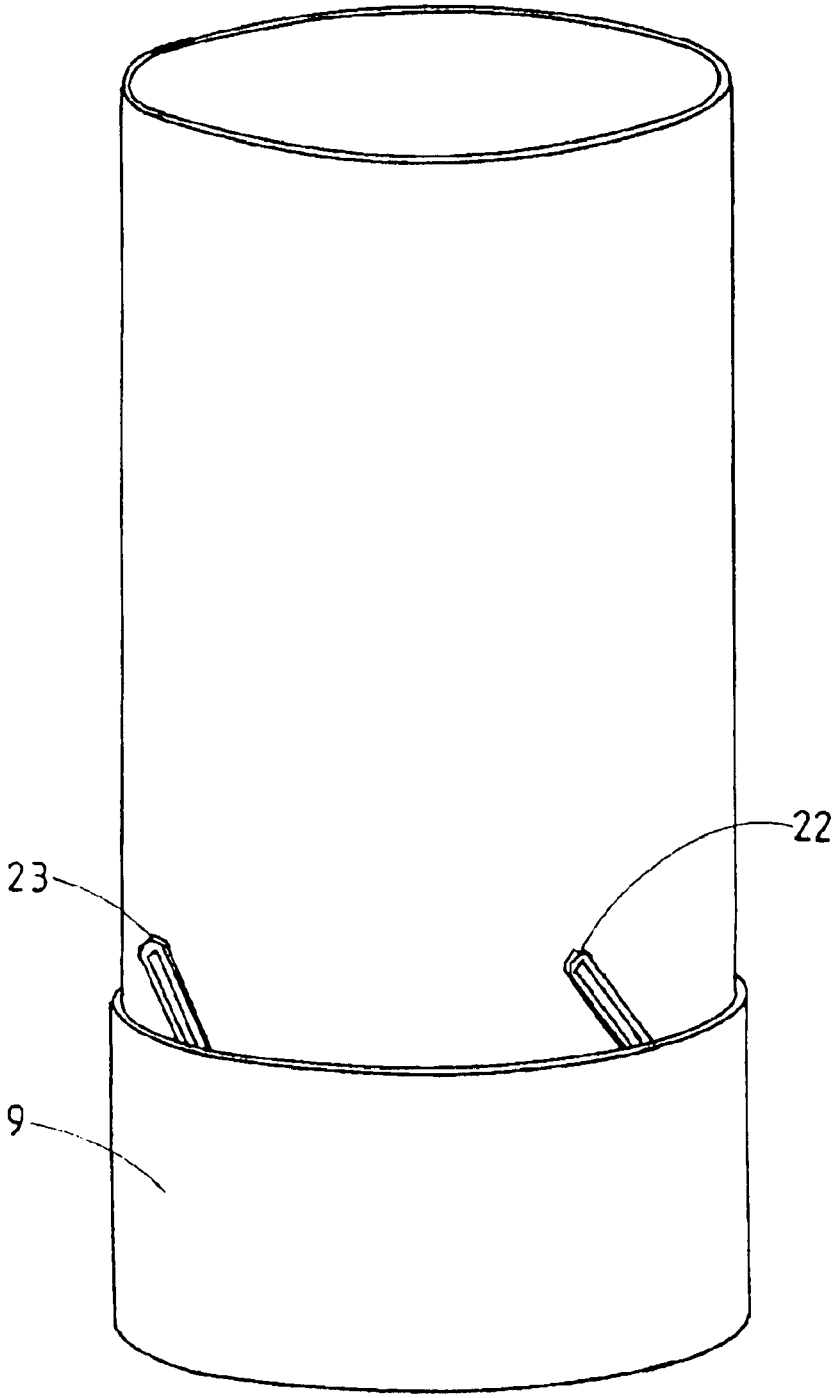
FIG. 3 is an elevational view of a monolithic quadrifilar helix antenna constructed in accordance with the teachings of the present invention and FIG. 4 is an enlarged view of an inductive shunt.

To fabricate the quadrifilar helix antenna of the present invention, the planar antenna of FIG. 1 is bent inwardly into a cylinder as illustrated in FIG. 3. Note that in FIG. 3, the front side of the antenna 1 is located within the cylinder whereas the rear side is outside. This is done to protect the radiating elements 4–7 and feed circuit 8 from possible damage due to handling and thereby eliminating the need to later run performance tests. Thus, in an alternative embodiment, the planar antenna of FIG. 1 may be bent outward to expose the hybrid junction power divider feed circuit 8 and radiating elements 4–7.

Figure 4:
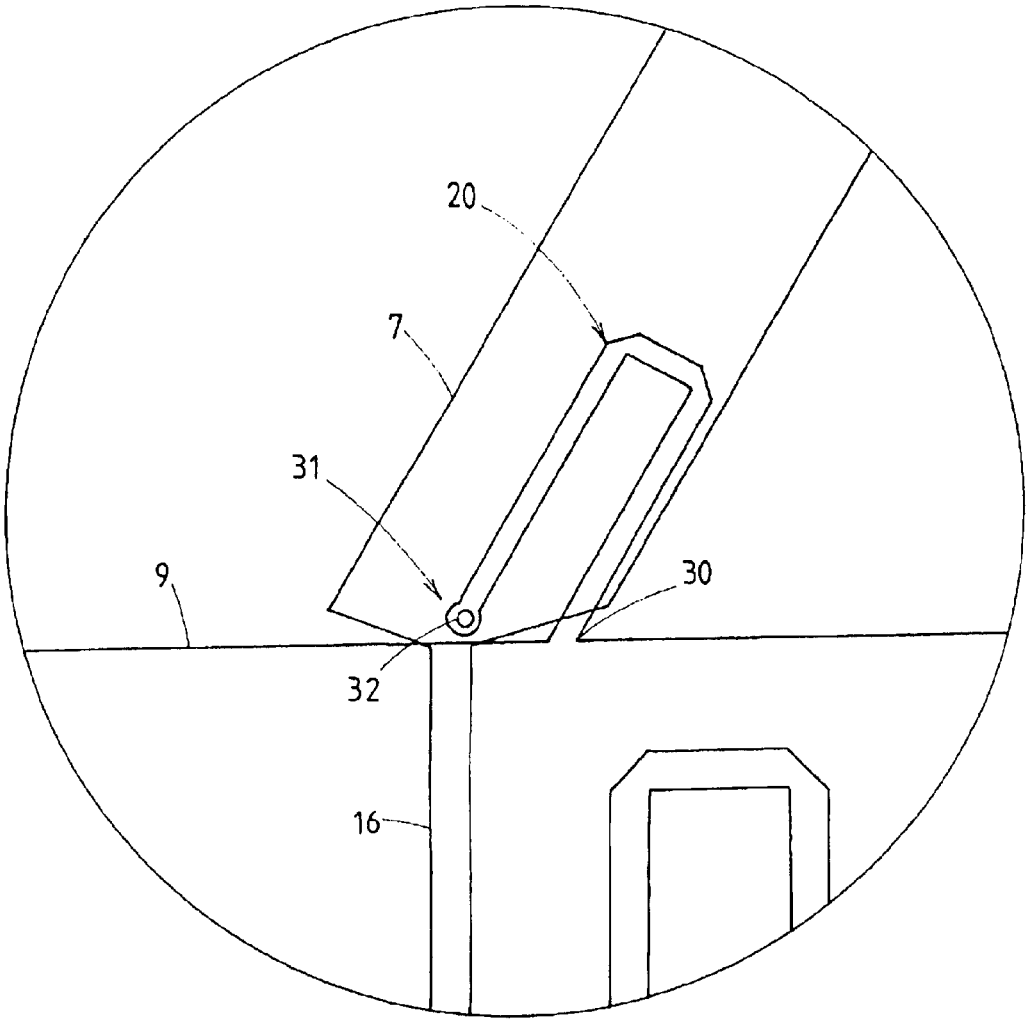

The shunt inductors 20–23 are identical and an illustrative one 20 is shown in detail in FIG. 4. The inductor 20 is in the form of a U-shaped stub with a proximal end 30 contiguous with the ground plane 9, and a distal end 31 with a plated-through hole 32. The plated-through hole 32 passes through the base of the radiating element 7, spaced slightly from the junction between the radiating element 7 and the phased line 16.

The shunt inductors 20–23 provide a Smith Chart impedance matching technique. That is, they provide a reactance in parallel with a load to rotate the desired frequency locus (load) about a constant admittance curve. Specifically, the shunt inductors 20–23 rotate the desired frequency locus (load) from a low resistance, capacitive impedance to 50 ohms purely resistive. The length of the stub inductors can be adjusted to control the inductance, and the length of the radiating elements can be adjusted for proper frequency.

To manufacture the antenna of the present invention, the hybrid junction power divider feed circuit 8 has to first be designed to provide impedance matching and 0 to 180° phase shift while fitting into a particular chosen area. Secondly, the 0° and 180° phase shift locations of the hybrid junction power divider feed circuit 8 have to be located. Thirdly, the correct length and impedance of the 90° phased lines 14, 16 must be established to allow for both n/4 wavelength mode of operation and phase quadrature between the antenna ports. Once the steps above are accomplished, the correct configuration of all pertinent parts of the antenna is simply etched or deposited onto a dielectric substrate. The dielectric substrate can be made of glass, fiberglass, Teflon or any other material or combination thereof. However, in this case a pliable dielectric substrate is used to facilitate the shaping of the planar antenna of FIG. 1 into a cylinder.

Once the deposition or etching of the copper on the dielectric substrate is completed, the antenna is bent into a cylinder. The antenna is then fastened in that shape by taping the edges of the upper section of the antenna together and by soldering or joining the edges of the ground plane 9 with conductive tape. Finally, a connector is soldered to the end of the input line 17.

Note that with this method, many antennas can be deposited or etched on a large section of dielectric substrate. After the deposition, each antenna can be die cut, rolled into a cylinder, soldered or joined at the right locations and be ready for use. Note also that the soldering is minimal (i.e., one or two soldering connections) and done on non-sensitive parts of the antenna (i.e., ground plane and connector).

In an alternative closed-circuit antenna (not shown), the radiating elements 4–7 may be connected by a shorting ring with ends which are joined together during assembly by conductive tape or solder. In this case the elements 4–7 are increased in length to operate in ½ wavelength mode.

In the illustrated embodiment, shunt inductors are used, but in alternative embodiments (not shown), the inductors 20–23 may be replaced by capacitive elements depending on the original complex impedance.

The shunt inductors 20–23 are compact and efficient, and enable the output impedance to be close to 50 ohms without requiring bulky line transformers It has also been found that the initial tuning of the helix structure is much simplified over the raised feed design described in U.S. Pat. No. 6,184,844. Adjustment of the design in U.S. Pat. No. 6,184,844 requires simultaneous changes to the element length and feedpoint. In contrast, the use of shunt inductances only requires a single adjustment of the inductance, which remains stable over a reasonable frequency range. The length of the radiating elements 4–7 can be adjusted for frequency somewhat independently. The design shown in the figures has at least equal gain and pattern performance to raised feed designs, whilst enabling a compact 50 ohm feed network to be used. Additionally, with the choice of inductance as the reactive element, the effective length of the helix is modestly shortened. The helical structure remains realizable using simple P.C.B. fabrication on thin flexible substrates.

The present invention has been described herein with reference to particular embodiments for a particular application. Those having ordinary skill in the art and access to the present teachings will recognize additional modifications, applications and embodiments within the scope thereof.

For example, an amplifier may be inserted between the hybrid junction power divider feed circuit 18 and the 50 ohm line 17. The microstrip feed network 8 may be replaced by a waveguide or stripline coupler. The ring hybrid may be replaced by a coupled line hybrid. For instance in an alternative feed network, the 180° ring hybrid may be replaced by a 90° coupled line hybrid with a 0° degree port and a 90° port, and a 90° Schiffman phase shifter coupled to the 90° port. Thus it can be seen that this circuit configuration will produce a 180° phase difference between the 0° port and the output of the Schiffman phase shifter. Thus the 90° hybrid and Schiffman phase shifter can together be considered to constitute a 180° hybrid coupler. The radiating elements may be aperture fed as in U.S. Pat. No. 6,172,656.

The radiating elements can be phased to operate in either endfire or backfire mode, either in the open-circuit configuration of FIG. 1 or in closed circuit configuration. Although the feed network is shown with meandering lines to save space, it will be understood that straight lines may be used instead.

It will be appreciated by a skilled person that the actual phase difference between the ports may differ slightly from the approximate values given above: in practice the phase difference may vary by up to 2%, or even in extreme cases up to 5% either side of the approximate value.

A preferred application for the antenna is for receiving satellite Global Positioning System (GPS) signals.

In the case of a GPS system, the radiating elements operate in receive mode. However it will be appreciated that the invention may be applicable to an antenna operable only in transmit mode, or operable in both transmit and receive modes. Therefore it will be understood that the term "radiating element" relates to an element which can receive and/or transmit radiation.

It is therefore intended by the appended claims to cover any and all such applications, modifications and embodiments within the scope of the present invention.

What is claimed is:

1. An antenna including:

a feed network;

four or more helical radiating elements;

four or more impedance matching elements each coupling a respective radiating element to ground in parallel with the feed network; and a substrate which carries the radiating elements on a first side and a ground plane on a second side, wherein the substrate carries the impedance matching elements on the second side and each impedance matching element couples a respective radiating element to the ground plane in parallel with the feed network.

2. The antenna of claim 1 wherein each impedance matching element is a stub.

3. The antenna of claim 1 wherein each impedance matching element is an inductive element.

4. The antenna of claim 1 wherein each impedance matching element is a stub coupled to ground via a conductive short circuit connection.

5. The antenna of claim 1 wherein the antenna is a quadrifilar antenna having four radiating elements.

6. The antenna of claim 1 including four feed lines each connected to a respective radiating element at a respective junction, wherein each impedance matching element is connected at a connection point located at or adjacent to the junction.

7. The antenna of claim 6 wherein the connection point is located on the radiating element adjacent to the junction.

8. The antenna of claim 6 wherein the connection point is located on the feed line adjacent to the junction.

9. The antenna of claim 1 wherein the antenna is configured to transmit and/or receive circularly polarized radiation.

10. The network of claim 1 wherein the feed network is a microstrip feed network.

11. The network of claim 1, wherein the feed network includes a hybrid coupler.

12. The network of claim 11, wherein the hybrid coupler has no terminated port.

13. The network of claim 11 wherein the hybrid coupler is a ring hybrid.

14. The antenna of claim 1 wherein the feed network includes a 180° hybrid coupler having a feed port, a 0° port; a 180° port having an approximately 180° phase difference with the 0° port; a first antenna port coupled to the 0° port; a second antenna port coupled to the 0° port via a respective phased line, the second antenna port having an approximately 90° phase difference with the first antenna port; a third antenna port coupled to the 180° port; and a fourth antenna port coupled to the 180° port via a respective phased line, the fourth antenna port having an approximately 90° phase difference with the third antenna port.

15. The antenna of claim 1 wherein the feed network has an output impedance between 45 and 55 ohms.

16. The antenna of claim 1, wherein the radiating elements each have substantially the same length.

17. The antenna of claim 1, wherein the radiating elements are each coupled to the feed network at one end, and open circuited at another end.

18. An antenna including:

a feed network;

four or more helical radiating elements;

four or more impedance matching elements each coupling a respective radiating element to ground in parallel with the feed network;

a substrate which carries the radiating elements on a first side and a around plane on a second side, wherein each impedance matching element couples a respective radiating element to the ground plane in parallel with the feed network and each impedance matching element includes a plated-through hole passing through the substrate.

19. The antenna of claim 18 wherein each impedance matching element is a stub.

20. The antenna of claim 18 wherein each impedance matching element is an inductive element.

21. The antenna of claim 18 wherein each impedance matching element is a stub coupled to ground via a conductive short circuit connection.

22. The antenna of claim 18 wherein the antenna is a quadrifilar antenna having four radiating elements.

23. The network of claim 18 wherein the feed network is a microstrip feed network.

24. The network of claim 18 wherein the feed network includes a hybrid coupler.

* * * * *